United States Patent [19]

Lodrini

[11] Patent Number: 4,480,447

[45] Date of Patent: Nov. 6, 1984

[54] FINGER RING AND INSERT THEREFOR

[76] Inventor: Albert C. Lodrini, R.F.D. #2, Box 124A, Stonington, Conn. 06378

[21] Appl. No.: 391,729

[22] Filed: Jun. 24, 1982

[51] Int. Cl.[3] ..... A44C 9/02

[52] U.S. Cl. ..... 63/15.6

[58] Field of Search ..... 63/15.6

[56] References Cited

U.S. PATENT DOCUMENTS

| | | | |
|---|---|---|---|
| 1,115,764 | 11/1914 | Applas | 63/15.6 |
| 3,465,544 | 9/1969 | Tucker | 63/15.6 |
| 3,483,718 | 12/1969 | Lodrini | 63/15.6 |

*Primary Examiner*—F. Barry Shay

*Attorney, Agent, or Firm*—McCormick, Paulding & Huber

[57] ABSTRACT

A finger ring has a saddle-shaped insert fitted to the lower portion of the ring, and a leaf spring may be provided between the ring and the insert, or the insert itself may itself be of resilient deformable material. The insert preferably has depending tangs which can be bent around the outside edge of the ring to hold it in place. The leaf spring has laterally projecting portions at its midportion which portions are received in slots of the insert side portions and tabs may be provided on the ends of the leaf spring to fit into cavities provided on the inner edge of the ring band. Alternatively these tabs may be defined on the ends of the insert itself when the insert is made of a resiliently deformable material.

2 Claims, 8 Drawing Figures

FINGER RING AND INSERT THEREFOR

BACKGROUND OF INVENTION

In my prior U.S. Pat. No. 3,483,718 issued to me Dec. 16, 1969 various insert devices are disclosed for narrowing the cross sectional size of a finger ring. That patent disclosure is incorporated by reference herein. A disclosure document No. 107113 filed by me on Mar. 22, 1982 is also incorporated by reference herein.

The prior invention of said U.S. Pat. No. 3,483,718 relates to finger rings with saddle shaped inserts provided in a lower portion of the band to "size" the ring down to fit smaller fingers and/or to provide a more secure retention of the ring on a given size finger. The inherent resiliency of such inserts provides a self-adjusting feature such that the ring is less likely to be lost by inadvertent removal from the wearer's finger.

More particularly, and taking my above mentioned patent as a prior art starting point, the present invention provides a much improved and more economical insert retention configuration.

SUMMARY OF INVENTION

The saddle-shaped inserts shown and described herein do not require protuberances or slots in the ring band to retain the saddled shaped insert. This is a significant advantage where one may want to use the ring without the insert for example. Also, this configuration for the ring band assures that no unsightly departures from the conventional annular band will detract from the ring's appearance whether or not an insert is used.

The present invention relates to improvements to ring inserts of the general type shown and described in my prior patent, and deals more particularly with an insert for a finger ring of conventional external appearance such that the ring itself can be wore without the insert and no protuberances or slots are required in the ring band to secure the insert in place. The absence of such protuberances or slots assures that the appearance of the ring without such an insert does not give rise to the aesthetic objections likely attaching to a ring of the type shown in my prior U.S. Pat. No. 3,483,718.

The insert itself is new, and is adapted to be securely held in the ring band when used to size the ring downwardly. An important feature of one embodiment of the new insert is the one piece construction of the saddle and leaf spring portions. Instead of providing a subassembly of saddle and spring with fastener means to join these two portions a single resiliently deformable insert can be mounted in the lower portion of the ring band to size downwardly a ring of otherwise conventional external appearance.

In a two-piece embodiment, that is with a saddle and separate spring member comprising the insert for the ring band, the spring has projections at its midpoint received in slots of the saddle. Tabs may be provided at the opposite ends of the spring to be received in cavities opening only to the inner edge of the ring band, or the saddle may be provided with projections which can be bent around the outside edge of the ring band to secure the insert assembly to the ring.

DETAILED DESCRIPTION OF THE DRAWINGS

Figure 1:
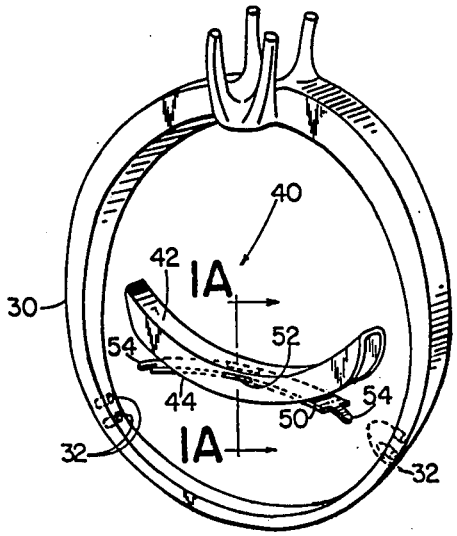
FIG. 1 is a perspective view of a finger ring and associated insert, both being shown in exploded relationship relative to one another.
Figure 1A:
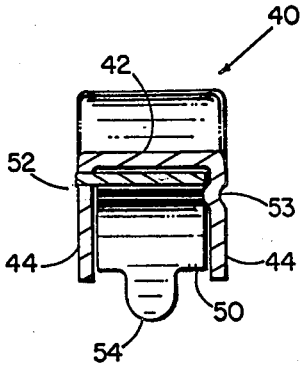
FIG. 1A is a vertical sectional view through the insert of FIG. 1 being taken on the line 1*a*—1*a* of FIG. 1.

Turning next to a description of the ring and insert illustrated in FIGS. 1 and 1A, a finger ring is designated generally at 30, and the ring is of conventional configuration having a generally circular band portion and an enlarged head portion for receiving a gem or the like. Prongs in the head portion are adapted to form a seat for the gem or other decorative object. The lower portion of the band has generally circular cavities 32, 32 formed in the inner edge of the band so as not to be visible from the exterior when the ring is worn by a person on his finger. These generally circular cavities or bores 32, 32 are spaced from one another and arranged in at least one pair such that each pair provides a predetermined peripheral spacing along the interior edge of the ring band to receive a saddle-shaped insert such as shown at 40.

The saddle-shaped insert 40 has a U-shape such that a top wall 42 is formed to this same generally circular contour of the ring band lower portion, and side walls 44, 44 which side walls are adapted to cooperate with the opposed faces of the ring band lower portion when the insert 40 is assembled with the ring 30 as suggested in my prior art patent which is incorporated by reference herein.

Still with reference to the unique insert 40 depicted in FIGS. 1 and 1A, a leaf spring 50 is provided inside the U-shaped insert 40 and has a midportion defining at least laterally projecting tab 52, which tab is adapted to fit into a slot provided for this purpose in the side portions of the insert saddle 40. The saddle 40 may be crimped as shown at 53 in FIG. 1A opposite this tab receiving slot so as to retain the leaf spring in the unstressed position shown for it in FIG. 1. Tabs 54, 54 are defined at the opposite end portions of the leaf spring 50 which tabs fit into one set of the cavities 32, 32 provided for this purpose in the ring band lower portion. As so constructed and arranged the insert 40 is adapted to be assembled with the ring 30 in much the same manner as taught in my above mentioned, prior art U.S. Pat. No. 3,483,718. However, it should be noted that the ring 30 and more particularly the band portion thereof does not include any protuberances or slots which might be visible when the ring 30 is worn without such an insert as that depicted at 40 in FIG. 1. That is, the ring 30 can be worn without the insert 40 and the inwardly open cavities 32, 32 are hidden from view when the ring is so worn.

Figure 2:
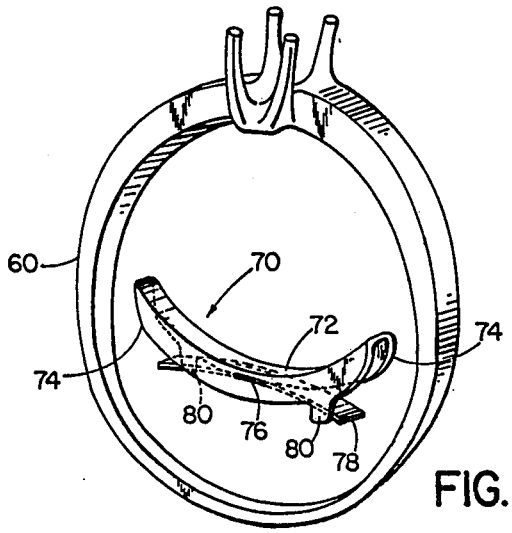
FIG. 2 is a perspective view similar to FIG. 1 showing a different insert and ring configuration.
Figure 3:
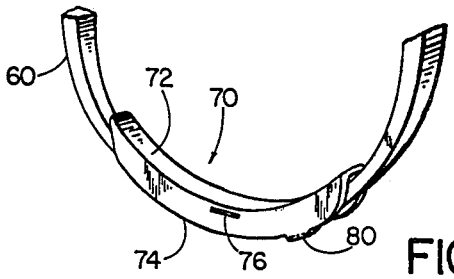
FIG. 3 is a perspective view of the lower portion of the ring band illustrated in FIG. 2 with the insert of FIG. 2 assembled therewith.

Turning next to a detailed description of the second embodiment illustrated in FIGS. 2 and 3, a ring 60 is shown generally similar to that described above with reference to the ring 30 of FIG. 1, however the lower band portion of the ring 60 does not include any inwardly open cavities or bores as described above with reference to the numerals 32, 32. Instead, the ring 60 is of entirely conventional configuration but is adapted to be sized downwardly as a result of utilization of the insert 70 depicted inside the ring 60 in FIG. 2. The insert 70 is generally similar to that described above with reference to the insert 40 of FIG. 1 in that the insert 70 has top and side portions 72 and 74 respectively which cooperate to define a generally U-shaped insert saddle having at least one slot 76, at the midpoint of a depending side wall 74 so as to receive the projecting portion of a leaf spring 78 similar to the midportions 52, of the leaf spring 50 described above. The end portions of leaf spring 78 are not provided with tabs but instead are adapted to slidingly engage the inner edge of the ring 60 and more particularly the lower band portion thereof without necessity for interlocking with the ring band 60 as described above with reference to the embodiment of FIG. 1. The insert 70 of FIG. 2 is instead assembled with the ring 60 by bendable tabs 80, 80 provided at opposite ends of the depending side portions 74, 74 such that the insert 70 can be assembled with the ring 60 as shown in FIG. 3 and these tabs 80, 80 bent around the outer edge of the ring band 60 to secure the insert 70 and the ring 60 in assembled relationship with one another.

Figure 4:
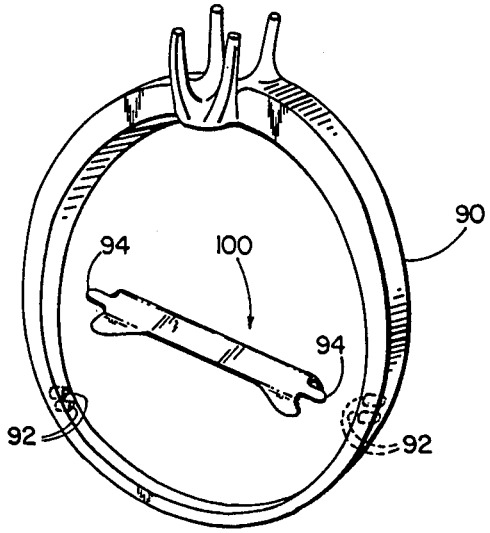
FIG. 4 is a perspective view similar to FIGS. 1 and 2 illustrating a third embodiment of the present invention.

Turning next to the embodiment illustrated in FIGS. 4, 5, 6 and 7, a ring 90 generally similar to the ring 30 described above with reference to FIG. 1 is illustrated in FIG. 4 and includes cavities 92, 92 open to the inner edge of the ring in it's lower portion for receiving projecting tabs 94, 94 of a saddle-shape insert 100 to be described. In the embodiment of FIG. 4 the insert 100 is itself formed of a resilient deformable material so that there is no need for separate saddle and leaf spring elements as decribed in my prior art patent and as shown and described with reference to FIGS. 1–3 herein.

Figure 6:
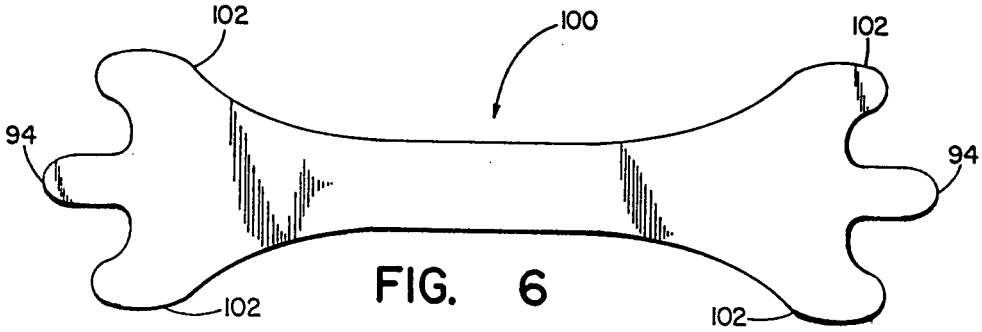
FIG. 6 is a plan view of the saddle-shaped insert of FIGS. 4 and 5 prior to shaping the insert and resiliently deforming the same for assembly with the ring band.
Figure 7:
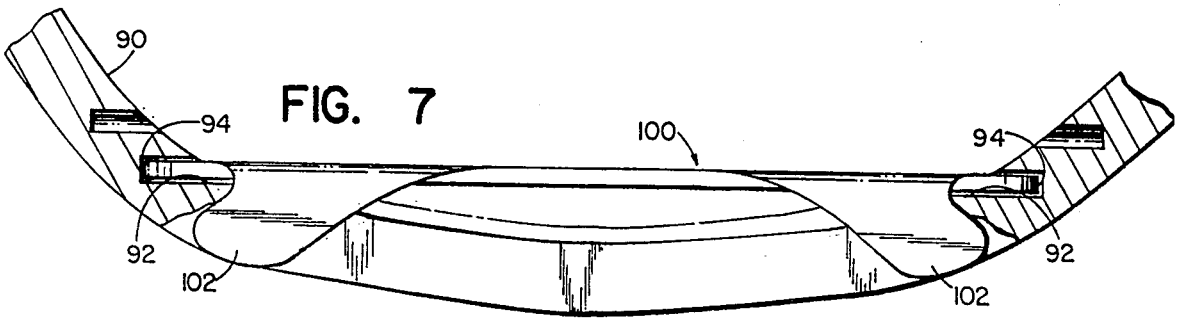
FIG. 7 is a view of the saddle-shaped insert depicted in FIGS. 4, 5 and 6 illustrating in solid lines the unstressed configuration of the resilient deformable insert and in broken lines the resiliently deformed configuration of the insert.

The insert 100 is best shown in FIG. 6 in its initial configuration (that is in a flat condition) prior to being formed into the shape illustrated for it in solid lines in FIG. 7. FIG. 7 illustrates the insert 100 in an unstressed condition wherein the insert has a generally U-shape configuration with depending portions 102, 102 and with projecting end portions or tabs 94, 94 as described previously with reference to FIG. 4. The solid line configuration for the insert 100 in FIG. 7 is generally similar to that illustrated for this insert 100 in FIG. 4. FIG. 7 illustrates in broken lines the deformed condition for the insert 100 where it is resiliently bent so that the tabs 94, 94 are adapted to fit into the cavities 92, 92 provided for this purpose in the lower portion of the ring band 90.

Figure 5:
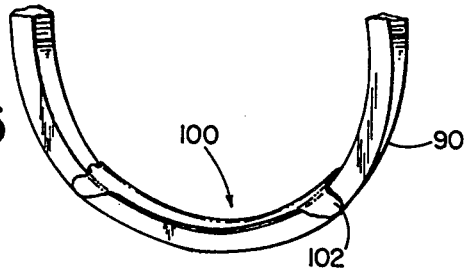
FIG. 5 is a view similar to FIG. 3 but illustrating the inset of FIG. 4 mounted to the ring band of FIG. 4.

Finally, FIG. 5 illustrates the final configuration for the resilient insert 100, wherein the projecting leg portions 102, 102 are bent alongside the exterior sides of the ring band 90 to secure the insert 100 to the ring 90. This shape would be achieved for example when the ring was being worn on a finger.

All inserts disclosed herein allow a degree of movement for the insert after assembly with a ring in the manner described above. That is, the ring wearer will be able to quite easily move the ring past his knuckle because the insert will move radially outwardly with respect to the band or shank in which it is mounted. Once the ring is in position on the wearer's finger the resiliency of the insert will serve to hold the ring on his or her finger much more securely than would be the case with a conventional ring without such an insert. The insert is biased by the spring or by its own resiliency to achieve this holding function on the finger.

I claim:

1. In a finger ring having a lower band portion with an inner edge defining a finger opening, the improvement comprising a saddle-shaped insert means having top and side walls adapted to fit over said lower portion of said band, a leaf spring, at least two peripherally spaced cavities which open only to said inner edge of said ring band, said insert means defining at least two projecting tabs adjacent end portions thereof and adapted to fit into said at least two cavities respectively, said leaf spring being disposed under said top wall and having at least one laterally projecting portion at its midpoint, said projecting spring portion being received in an aligned opening of said saddle-shaped insert means side wall, said leaf spring being resiliently deformed by bending when said tabs are so fitted into said cavities.

2. In a finger ring having a lower band portion with an inner edge free of any protuberances or recesses and defining a finger opening, the improvement comprising a saddle-shaped insert means having top and side walls adapted to fit over said lower portion of said band, said insert means including a leaf spring disposed under the top wall thereof, said leaf spring having end portions engaging said inner edge of said band and having a mid-portion defining at least one laterally projecting portion received in an opening of said insert means side wall, and said insert means side walls defining at least a portion projecting peripherally outwardly beyond said lower band inner edge, and said projecting wall portion being bent parallel to the exterior of said lower band portion to secure said insert means to said band.

* * * * *